US008607418B2

(12) United States Patent
Ebbenga

(10) Patent No.: US 8,607,418 B2
(45) Date of Patent: Dec. 17, 2013

(54) LATCH FOR BOAT BOW

(76) Inventor: Mark Ebbenga, Forest Lake, MN (US)

( * ) Notice: Subject to any disclaimer, the term of this patent is extended or adjusted under 35 U.S.C. 154(b) by 67 days.

(21) Appl. No.: 12/740,482

(22) PCT Filed: Oct. 30, 2008

(86) PCT No.: PCT/US2008/081751

§ 371 (c)(1),
(2), (4) Date: Sep. 14, 2010

(87) PCT Pub. No.: WO2009/058977

PCT Pub. Date: May 7, 2009

(65) Prior Publication Data

US 2011/0005453 A1 Jan. 13, 2011

Related U.S. Application Data

(60) Provisional application No. 60/984,583, filed on Nov. 1, 2007.

(51) Int. Cl.
*F16G 11/10* (2006.01)

(52) U.S. Cl.
USPC ..... 24/134 L; 24/132 R; 114/343; 114/230.1; 294/82.27; 294/82.19

(58) Field of Classification Search
USPC ..... 114/230.1, 230.2, 230.24, 230.25, 114/230.26, 230.28, 230.29, 230.3, 364; 24/115 R, 132 R, 712.6, 134 L, 457, 633, 24/636, 643, 598.9, 599.1, 599.2; 292/95, 292/121, 125, 133, 99, 240, 194, 219, 225, 292/235, 198; 294/82.17, 82.1, 82.19, 82.2, 294/82.23, 82.24, 82.27, 82.22, 82.31, 294/82.33
See application file for complete search history.

(56) References Cited

U.S. PATENT DOCUMENTS

| | | | | | |
|---|---|---|---|---|---|
| 447,421 | A | * | 3/1891 | Wogan | 114/380 |
| 965,655 | A | * | 7/1910 | Porter | 114/380 |
| 998,524 | A | * | 7/1911 | Jordan | 294/82.27 |
| 1,576,197 | A | * | 3/1926 | Kuffel et al. | 294/82.19 |
| 2,347,718 | A | * | 5/1944 | Terry | 294/209 |
| 3,045,634 | A | | 7/1962 | Dorsett | |
| 3,540,083 | A | * | 11/1970 | O'Connor | 403/209 |
| 3,632,138 | A | * | 1/1972 | Whiteley, Jr. | 280/405.1 |
| 3,861,731 | A | | 1/1975 | Young | |
| 3,918,386 | A | | 11/1975 | McClain | |
| 3,918,758 | A | * | 11/1975 | Fournier | 294/82.36 |

(Continued)

OTHER PUBLICATIONS

International Search Report, Jun. 22, 2009.

*Primary Examiner* — Robert J Sandy
*Assistant Examiner* — Abigail E Morrell
(74) *Attorney, Agent, or Firm* — Westman, Champlin & Koehler, P.A.; Z. Peter Sawicki

(57) ABSTRACT

A latching mechanism for use in securing a boat that is afloat, includes a main body having a channel for accepting a line that will hold the boat. A latching member is pivotally secured within the main body and is movable between a position that closes off the channel and movable to a position which opens the channel, the latching member being pivotable about a pivot point on the main body. A spring force holds the latching member in a closed position and a cable attached to the latching member at a location on an opposite side of the pivot point pivots the latching member to an open position.

5 Claims, 3 Drawing Sheets

(56) References Cited

U.S. PATENT DOCUMENTS

| | | | | | |
|---|---|---|---|---|---|
| 3,938,829 | A | | 2/1976 | Anderson | |
| 4,045,064 | A | * | 8/1977 | Okada | 292/125 |
| 4,126,095 | A | * | 11/1978 | Tillery | 410/96 |
| 4,173,196 | A | * | 11/1979 | Casad et al. | 114/253 |
| 4,193,627 | A | * | 3/1980 | Cranston et al. | 294/82.19 |
| 4,195,872 | A | * | 4/1980 | Skaalen et al. | 294/82.19 |
| 4,281,867 | A | * | 8/1981 | Kariagin | 294/82.33 |
| 4,458,620 | A | | 7/1984 | Bingham | |
| 4,471,511 | A | * | 9/1984 | Phipps | 294/82.33 |
| 4,531,470 | A | | 7/1985 | Paul | |
| 4,693,164 | A | * | 9/1987 | Grinwald | 89/1.13 |
| 4,751,892 | A | * | 6/1988 | Sechel et al. | 114/221 R |
| 4,890,566 | A | | 1/1990 | Morris | |
| 4,919,446 | A | | 4/1990 | Higgins | |
| 4,995,629 | A | | 2/1991 | Poppell | |
| 5,263,733 | A | | 11/1993 | Kastenberger et al. | |
| 5,408,946 | A | | 4/1995 | Jones et al. | |
| 5,538,303 | A | * | 7/1996 | Dunham | 294/82.31 |
| 5,599,035 | A | | 2/1997 | Spence | |
| 5,727,834 | A | * | 3/1998 | Weselowski | 294/82.19 |
| 6,863,347 | B2 | * | 3/2005 | De Nichilo | 297/378.12 |
| 6,904,861 | B1 | | 6/2005 | Warner et al. | |
| 7,179,041 | B2 | | 2/2007 | Ebbenga | |
| 2003/0052511 | A1 | * | 3/2003 | Shaw et al. | 296/120.1 |

* cited by examiner

LATCH FOR BOAT BOW

This Application is a Section 371 National Stage Application of International Application No. PCT/EP2007/009404, filed Oct. 30, 2007 and published as WO 2009/056151 A1 on May 7, 2009, the content of which is hereby incorporated by reference in its entirety.

BACKGROUND OF THE INVENTION

The present invention relates to docking and launching of a boat, and in particular, it relates to securing and releasing a boat to and from a docking line.

There have been a number of attempts in the past to secure a boat to a docking line. The following U.S. Patents describe examples of such devices:

| | |
|---|---|
| C. T. Dorsett | 3,045,634 |
| McClain | 3,918,386 |
| Anderson | 3,938,829 |
| Bingham | 4,458,620 |

Other boat securing devices using latches, although not specifically used for docking, are described in the following patents:

| | |
|---|---|
| Anderson | 3,938,829 |
| Higgins | 4,919,446 |
| Poppell | 4,995,629 |
| Warner et al. | 6,904,861 |
| Kastenberger et al. | 5,263,733 |
| Spence | 5,599,035 |

SUMMARY

A latching mechanism for use in securing a boat that is afloat includes a main body having a channel for accepting a line that will dock the boat. A latching member is pivotally secured within the main body and is movable between a position that closes off the channel and movable to a position which opens the channel, the latch being pivotable about a pivot point on the main body. A spring force holds the latch in a closed position and a cable attached to the latch at a location on an opposite side of the pivot point when pulled pivots the latch to an open position against the spring force.

DETAILED DESCRIPTION

Figure 1:
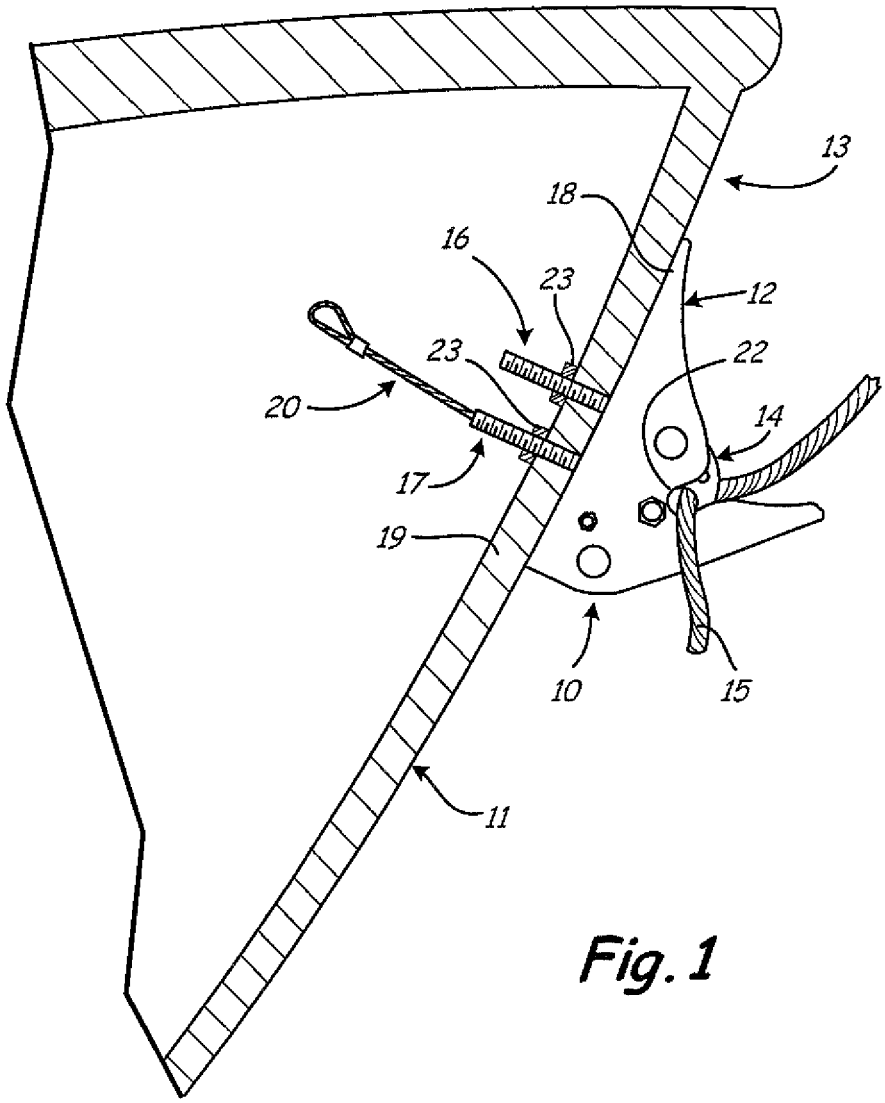
FIG. 1 is a side elevational view of the bow latch attached to the bow of a boat shown in sectional.

This disclosure describes a latch generally illustrated at 10 for use on a bow 11 of a boat 13 as illustrated in FIG. 1. The purpose of the bow latch 10 is to secure the boat 13 to a line 15 that is extending horizontally. Such a line may be part of a winching system that winches the boat onto a trailer (not shown). One suitable winching system is described in U.S. Pat. No. 7,179,041 which is herein incorporated by reference in its entirety. The latch 10 may also be used to secure the boat to a docking line. Once the boat is secured by the bow latch being attached to the line, the boat may be winched onto the trailer. Conversely, when the boat is taken off the trailer and placed into the water, the latch 10 releases the bow 11 from the line 15. Similarly, when the boat is attached to a docking line that stretches between two docks, the bow latch by engaging the docking line secures the boat in a docking position and releases the boat by disengaging from the docking line.

As illustrated in FIG. 1, the bow latch 10 includes a main body 12 in which a latching member 14 in the form of a hook operates. As illustrated in FIG. 1, the hook member 14 is in a closed or latching position securing the line 15.

The bow latch 10 further includes a first bolt 16 and a second bolt 17 extending away from a boat facing surface 18 of the main body 12. The bolts 16 and 17 are sufficiently long to extend through a hull 19 of the boat 13. Both bolts have threaded surfaces which cooperate with nuts and washers 23 to secure the bow latch 10 to the exterior surface of the bow 11.

Bolt 17 further has a hollow interior extending from an end of the bolt into the interior of the main body 12 of the bow latch 10. A cable 20 is positioned within the interior of the bolt 17 for moving the hook member 14 which will be described subsequently.

Figure 2:
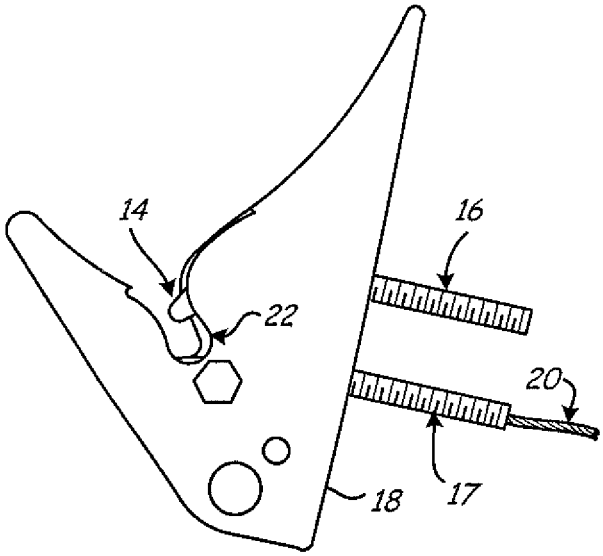
FIG. 2 is a side elevational view of the latch in an open position.
Figure 3:
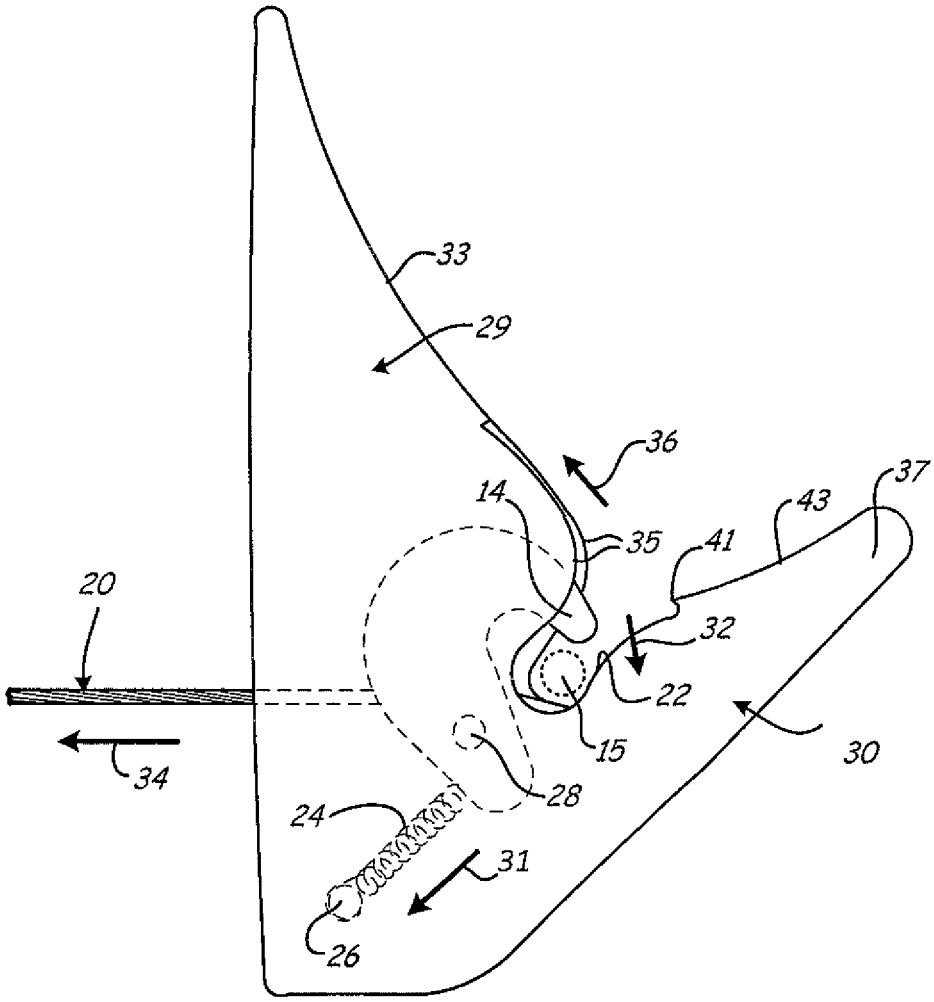
FIG. 3 is a side elevational view of the latch illustrating selected internal parts of the latch to show its operation.

The bow latch 10 is illustrated in the unlatched position in both FIGS. 2 and 3. The main body 12 includes an upper portion 29 and a lower portion 31 configured to guide the line 15 into the channel 22. The upper portion 29 includes a sloped edge surface 33 that has lower curved edge portions 35 curving toward channel 22. The hook member 14 moves between the edge portions 35 typically activated by pulling on the cable 20. The lower portion 30 has a nose portion 37 that extends outwardly and upwardly substantially beyond the channel 22 to engage the line 15 and then to guide the line to the channel 22.

A catch 41 positioned on an upper edge surface 43 of the lower portion 31 helps retain the line 15 proximate to the channel 22. It will be appreciated that the movement of the boat aids in moving the line 15 to the channel 22.

As more clearly illustrated in FIG. 3, the hook member 14 pivots about a pivot point 28. To keep the hook member 14 in a latched or closed position, a spring 24 is attached to the hook member 14 on one side of the pivot point 28 and is secured at another end to a stationary pin 26. Preferably, the spring 24 and the hook member 14 are positioned within an interior chamber of the main body 12. The stationary pin 26 is secured to the main body 12. The spring, however, can be secured to the main body in any fashion, the purpose being to secure the spring at that end.

Spring force 30 is directed toward the pin 26 thereby keeping, the hook member in the closed position as indicated by arrow 32. When the cable 20 is pulled in the direction of arrow 34, the hook member 14 pivots against the spring force 30 to an open or unlatched position as indicated by arrow 36. Inserting the hook member to an open or unlatched position releases the line 15 from the latch 10. Depending on the strength of the spring force 30, the hook member can be pivoted to an open position by the force of the line working against the hook member. Once the line is secured, the hook member is biased to the closed position keeping the line within the channel 22 of the latch 10. Of course, when the spring force exceeds the force of the line engaging the hook member 14, the cable 20 can be pulled to open the channel 22 manually and secure the line within the latch 10.

Although the present invention has been described with reference to preferred embodiments, workers skilled in the art will recognize that changes may be made in form and detail without departing from the spirit and scope of the invention.

What is claimed is:

1. A latching mechanism comprising:

a main body having a channel for accepting a dock line;

a latching member pivotally secured within the main body and moveable between a latching position and an unlatching position, the latching member being pivotable about a pivot point on the main body;

a spring force within the main body holding the latching member in the latching position;

a cable attached to the latching member at a location on an opposite side of the pivot point to pivot the latching member to the unlatching position against the spring force and wherein the cable is attached to the latching member at the location on the opposite side of the pivot point from the spring force, such that the pivot point is between the cable and the spring force;

a first and second bolt securing the latching member to a bow of a boat wherein at least one bolt is hollow;

wherein the cable extends through the hollow bolt.

2. The latching mechanism of claim 1 wherein the spring force is provided by a coil spring.

3. The latching mechanism of claim 1 wherein the main body has an upper portion and a lower portion, the portions being of a shape and configuration for guiding the dock line into a channel.

4. The latching mechanism of claim 1 wherein the latching member is in the shape of a hook.

5. The latching mechanism of claim 1 wherein the latching member is pivotable to the latching position to close off the channel after the dock line is accepted in the channel.

* * * * *

UNITED STATES PATENT AND TRADEMARK OFFICE

CERTIFICATE OF CORRECTION

PATENT NO. : 8,607,418 B2
APPLICATION NO. : 12/740482
DATED : December 17, 2013
INVENTOR(S) : Mark Ebbenga It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 305 days.

Signed and Sealed this
Twenty-second Day of September, 2015

Michelle K. Lee

Michelle K. Lee
*Director of the United States Patent and Trademark Office*